United States Patent [19]

Hargest

[11] Patent Number: 4,854,469

[45] Date of Patent: Aug. 8, 1989

[54] POLLUTION CONTROL APPARATUS FOR MARINE FUEL TANKS

[76] Inventor: Thomas S. Hargest, P.O. Box 21118, Charleston, S.C. 29413

[21] Appl. No.: 252,809

[22] Filed: Oct. 3, 1988

[51] Int. Cl.[4] ..... B65D 11/22

[52] U.S. Cl. ..... 220/86 R; 220/205

[58] Field of Search ..... 220/85 S, 85 VR, 85 F, 220/205, 368, 373, 86 R

[56] References Cited

U.S. PATENT DOCUMENTS

| | | | |
|---|---|---|---|
| 1,056,842 | 3/1913 | Sharp | 220/205 |
| 1,209,100 | 12/1916 | Anderson | 220/86 R |
| 1,242,176 | 10/1917 | Gross | 220/86 R |
| 1,988,325 | 1/1935 | Mobley | 220/205 |
| 2,037,731 | 4/1936 | Mobley . | |
| 2,061,175 | 11/1935 | Staber . | |
| 2,093,575 | 9/1937 | Roberts . | |
| 2,472,665 | 6/1949 | Ladner | 220/86 R X |
| 3,136,292 | 6/1964 | Mitchell . | |
| 4,166,431 | 9/1979 | Pickering . | |
| 4,376,490 | 3/1983 | Mizusaki . | |
| 4,531,653 | 7/1985 | Sakata . | |
| 4,535,910 | 8/1985 | Nagashima . | |

*Primary Examiner*—Steven M. Pollard

*Attorney, Agent, or Firm*—Dority & Manning

[57] ABSTRACT

A pollution control device for marine fuel tanks includes a conduit attachable to a fuel tank vent defined in the hull of a boat. The conduit is connected through an opening in a housing to an inlet tube which extends inside the housing. The floor of the housing slopes toward the inlet tube which has defined therein a liquid fuel outlet opening. A separation baffle extends from the top of the housing down toward the floor and away from the fuel outlet opening. On the side of the separation baffle opposite the side on which the inlet tube is disposed, a vapor opening is defined through the top wall of the housing. A flow turning baffle is disposed on the same side of the separation baffle as the vapor opening. A transparent section forms a portion of the housing sides and top that permits visual observation of the inlet tube, which extends into the housing to a height at a level higher than the level at which the free end of the separation baffle terminates. The flow turning baffle requires fuel to make a number of 180° turns before being able to exit through the vapor opening.

18 Claims, 2 Drawing Sheets

POLLUTION CONTROL APPARATUS FOR MARINE FUEL TANKS

BACKGROUND OF THE INVENTION

The present invention relates generally to a pollution control apparatus and particularly to a fuel tank ventilation and baffle means for use on or with a marine fuel tank.

All fuel systems for boats must be vented to permit fuel to flow to the engine and for filling of the fuel tanks. On boats with integrated fuel tanks, the vent is generally located on the exterior of the hull near the interior location of the tank. In most cases, the vent is used when fueling to indicate the tank has been filled. A full tank is, for example, indicated by ejection of fuel from the vent. However, ejection of fuel into any river, lake, bay, inlet, or harbor is against Federal Law and may result in a fine of up to several thousand dollars. When it is considered that there are millions of boats with integrated tanks, many with three or four tanks, which are fueled at least weekly, it can be estimated that millions of gallons of fuel are likely discharged into the waterways each year.

It is known (U.S. Pat. No. 4,351,653) to provide an automobile fuel tank with a ventilation device to permit ventilation of the fuel tank without spillage. However, such a system does not disclose an overflow protection baffle in the vent means together with a means for determining or observing when the fuel tank is full. It is also known (U.S. Pat. No. 4,166,431) to provide a pair of depressed transparent windows for determining when a brake fluid reservoir is filled, while leaving space at the top of the reservoir for introduction of a closure cap without overflowing the container. However, U.S. Pat. No. 4,166,431 does not contemplate overflow baffle protection or ventilation means. It is further known (U.S. Pat. No. 2,093,575) to provide a transparent measuring receptacle for receiving gasoline to be dispensed, and including an overflow line. However, there is no disclosure of a proposed baffle system or vent combined therewith.

U.S. Pat. No. 3,136,292 discloses a radiator cap having a transparent member for observing whether sufficient liquid coolant is present within the upper reservoir chamber of the radiator. Tubes 60 and 62 have displaced free ends which, rather than protect against overflow, in fact cooperate with the presence of pressure within the radiator system to maintain a normal level of coolant fluid (FIG. 1). Thus, there is no disclosure of overflow protection or such combined with vent means.

U.S. Pat. Nos. 4,376,490 and 4,535,910 merely disclose transparent members permitting visual inspection of various fluid levels. U.S. Pat. Nos. 2,061,175 and 2,037,731 merely disclose various pressure related systems.

While the above described structures may be successful for their intended purpose, they are not analogous to the marine fuel tank vent art. Further, there is no teaching or suggestion of the present invention.

SUMMARY OF THE INVENTION

A primary object of this invention is to provide an improved fuel tank arrangement for marine use.

It is another object of the present invention to provide a means for determining when a fuel tank is full without any liquid fuel escaping to the surroundings.

It is a further object of this invention to provide a device for protecting the environment from pollution by controlling the discharge of the fuel from a fuel tank vent.

It is still a further object of the present invention to provide a device for protecting the environment by controlling the discharge of the fuel from several fuel tank vents and determining when several fuel tanks are full without fuel escaping to the surroundings.

Still another object of the invention is to provide a means for safely filling a marine fuel tank while at the same time conserving fuel.

Additional objects and advantages of the invention will be set forth in part in the description which follows, and in part will be obvious from the description, or may be learned by practice of the invention.

To achieve the objects and in accordance with the purpose of the invention, as embodied and broadly described herein, the marine craft with the pollution control apparatus for marine fuel tanks is powered by an internal combustion engine consuming volatile liquid fuel. As embodied herein, the marine craft can include a boat which comprises a hull that supports an internal combustion engine for propelling the boat through the water.

In further accordance with the present invention, the water craft includes at least one fuel tank, and preferably more than one tank, for storing the liquid fuel to be consumed by the internal combustion engine. As embodied herein, the boat can have two fuel tanks supported by the hull. Each fuel tank defines a fuel tank chamber therewithin where fuel is to be stored. A fuel tank chamber inlet nozzle permits fuel to be supplied to each fuel tank. A fuel tank cap is provided to seal each nozzle.

The fuel pollution control device according to the present invention communicates with the interior of each fuel tank chamber. As embodied herein, a fuel tank chamber vent line extends from an upper wall of the fuel tank to a vent opening defined in an upper aft section of the hull. As known in the art, each vent opening must be disposed above the water line of the hull and in the vicinity of the fuel tanks to provide effective venting for each fuel tank.

Preferably, a fuel pollution control device according to the present invention is attached to each vent opening. Such attachment can be effected permanently or temporarily during the fueling process of a particular fuel tank. In another manner of using the present invention, a separate pollution control apparatus can be provided for each vent opening and attached thereto regardless of whether the fueling operation is being carried on so that the pollution control apparatus is always in a ready and operable condition.

In further accordance with the present invention, the pollution control apparatus of the present invention includes means for housing fuel overflowing from the fuel tank chamber when the fuel tank is being filled past the capacity of the fuel tank chamber. As embodied herein for example, the overflow fuel housing means preferably includes a top wall, a bottom wall, and a side wall connecting the top wall and the bottom wall.

In further accordance with the present invention and as embodied herein for example, the bottom wall defines a fuel inlet opening therethrough.

In further accordance with the fuel pollution control device of the present invention, means are provided for conveying to the overflow fuel housing means, fuel overflowing from the fuel tank chamber when the fuel tank is being filled past capacity. The conveying means communicates with the fuel tank chamber and with the overflow fuel housing means. As embodied herein for example, the means for conveying fuel overflowing from the fuel tank chamber when the fuel tank is being filled past capacity preferably includes a conduit and a fuel inlet tube. The conduit communicates with the fuel tank chamber via the vent opening and the fuel tank chamber vent line. The conduit preferably defines a right angle elbow fitted at one end to one end of the fuel inlet tube and configured at the opposite end to be detachably coupled to the vent opening in the hull.

The fuel inlet tube communicates with the conduit and is disposed inside the overflow fuel housing means. The fuel inlet tube preferably is connected to the fuel inlet opening or extends therethrough and upwardly therefrom to a predetermined height within the overflow fuel housing means.

In further accordance with the fuel pollution control device of the present invention, means are provided for returning to the fuel tank chamber liquid fuel overflowing from the fuel tank chamber when the fuel tank is being filled past capacity. The liquid fuel return means preferably communicates with the overflow fuel housing means and with the fuel tank chamber. As embodied herein for example, the liquid fuel return means preferably includes at least one fuel outlet opening defined in the fuel inlet tube. The liquid fuel return means further includes a sloped floor disposed above the bottom wall of the overflow fuel housing means. The sloped floor is configured to slope toward the fuel outlet opening, which preferably is disposed in the fuel inlet tube so as to be at the same level as the sloped floor in the vicinity of the fuel inlet tube.

In still further accordance with the fuel pollution control device of the present invention means are provided for venting to atmosphere the volatile vapors emanating from the fuel being stored in the fuel tank. The fuel vapor venting means preferably communicates with the interior of the overflow fuel housing means. As embodied herein for example, the fuel vapor venting means includes at least one vapor opening defined in the top wall of the overflow fuel housing means. Each vapor opening connects the interior of the overflow fuel housing means with the atmosphere outside of the overflow fuel housing means. Thus, vapors contained within the overflow fuel housing means can escape the interior of the overflow fuel housing means by passing through a vapor opening and entering the surrounding atmosphere.

In still further accordance with the pollution control device of the present invention, means are provided for baffling the path of fluid within the overflow fuel housing means to prevent escape of liquid fuel from the overflow fuel housing means. The liquid fuel escape prevention means preferably is defined within the overflow fuel housing means. As embodied herein for example, the liquid fuel escape prevention means preferably includes at least two baffles. At least one of the baffles is a separation battle which is disposed inside the overflow fuel housing means and extends downwardly from the top wall of the overflow fuel housing means to a predetermined height. The separation baffle has a free end which points toward the bottom wall and away from the fuel inlet tube. The separation baffle functions to physically separate the liquid fuel from each vapor opening. At least another of the baffles defines a flow turning baffle which is also disposed within the overflow fuel housing means. The flow turning baffle is disposed on the same side of the separation baffle as the vapor opening. The flow turning baffle is configured to cause vapor to turn at least 180° before exiting through one of the vapor openings.

The fuel escape prevention means further includes the extension of the liquid fuel inlet tube into the overflow fuel housing means upwardly from the bottom wall and having a free end terminating at a height above the predetermined height where the separation baffle terminates.

In yet further accordance with the fuel pollution control device of the present invention, means are provided to permit visual observation of fuel overflowing from the fuel tank chamber and entering the overflow fuel housing means. As embodied herein for example, the means for permitting visual observation of overflowing fuel preferably includes a window defined in the overflow fuel housing means and disposed therein to permit visual observation of fuel entering the overflow fuel housing means through the fuel inlet tube. The window preferably defines a transparent section in an upper portion of the side wall and a portion of the top wall contiguous with the upper portion of the side wall. The window is preferably disposed so as to be visible to an operator who is filling the fuel tank via the fuel tank chamber inlet nozzle.

In operation, the person filling the fuel tank keeps an eye on the window of the pollution control apparatus as filling of the fuel tank is occurring. As soon as the operator observes fuel entering the overflow fuel housing means by observing same through the window, the operator stops putting fuel into the fuel tank. The fuel spurting through the free end of the inlet tube reaches there via the path formed by the fuel tank chamber vent line, the vent opening, the conduit, the fuel inlet opening, and the fuel inlet tube. The fuel entering the overflow fuel housing means includes both liquid and vapor. The liquid falls to the sloped floor and travels under the influence of gravity to exit the overflow fuel housing means via the fuel outlet opening provided at the place where the sloped floor meets the fuel inlet tube. Since fuel no longer is overflowing from the fuel tank, the liquid fuel can escape back down into the fuel tank via the fuel inlet opening, the conduit, the vent opening, and the fuel tank chamber vent line. The vapor must make a plurality of turns that includes at least one 180. turn in order to follow the exit path from the fuel overflow housing means via the vapor opening to pass into the atmosphere. As the vapor makes each turn in this path, any entrained liquid fuel is spun out of the vapor path under the influence of centrifugal force as the vapor makes these turns. The baffles serve to prevent liquid fuel from exiting the vapor opening. Accordingly, liquid fuel does not escape into the environment to pollute same.

DESCRIPTION OF THE PREFERRED EMBODIMENTS

What is presently considered the preferred embodiment of the present invention, an example of which is illustrated in the accompanying drawings, now will be described.

A preferred embodiment of the present pollution control apparatus for marine fuel tanks is shown in FIGS. 1–4 and is represented generally by the numeral 10.

Figure 1:
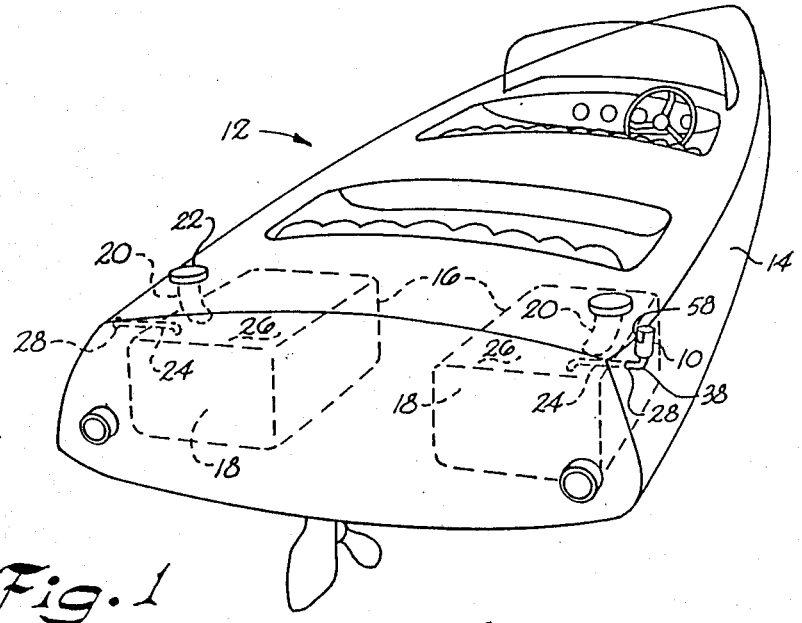
FIG. 1 illustrates a perspective view of a boat equipped according to an embodiment of the present invention.
Figure 2:
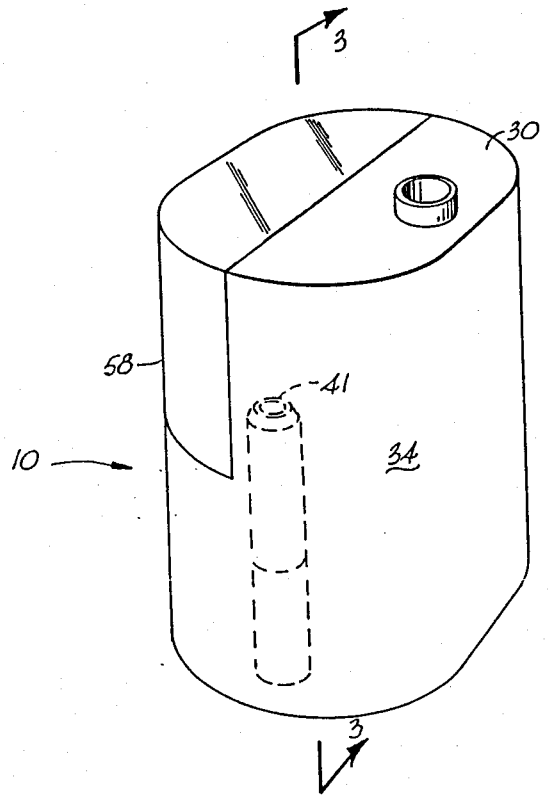
FIG. 2 illustrates a perspective view of a preferred embodiment of the present invention.

A water craft powered by an internal combustion engine consuming volatile liquid fuel is shown for example in FIG. 1. As shown in FIG. 1, the water craft defines a boat indicated generally by the numeral 12, and boat 12 comprises a hull 14. An internal combustion engine (not shown) is supported by hull 14 for propelling boat 12 through the water.

In further accordance with the present invention, the water craft includes at least one fuel tank, and preferably more than one tank, for storing the liquid fuel to be consumed by the internal combustion engine. As embodied herein and shown in FIG. 1 for example, boat 12 has two fuel tanks 16 indicated in phantom and supported by hull 14. Fuel tank 16 defines a fuel tank chamber 18 therewithin where fuel is to be stored. A fuel tank chamber inlet nozzle 20 is shown in phantom for each fuel tank 16. A fuel tank cap 22 is provided to seal each nozzle 20 for each fuel tank 16.

The pollution control device according to the present invention communicates with the interior of each fuel tank chamber. As embodied herein and shown in phantom in FIG. 1 for example, a fuel tank chamber vent line 24 extends from an upper wall 26 of fuel tank 16 to a vent opening 28 defined in an upper aft section of hull 14. As known in the art, each vent opening 28 must be disposed above the water line of hull 14 and in the vicinity of fuel tanks 16 to provide effective venting for each fuel tank 16.

As shown in FIG. 1 for example, a fuel pollution control device 10 according to the present invention preferably is attached to vent opening 28. Such attachment can be effected permanently or only temporarily, such as during the fueling process of a particular fuel tank. In another manner of using the present invention, a separate pollution control apparatus !0 can be provided for each vent opening 28 and remain attached thereto regardless of whether the fueling operation is being carried on. According to this latter arrangement, the pollution control apparatus is always in a ready and operable condition.

In further accordance with the present invention, the pollution control apparatus of the present invention includes means for housing fuel overflowing from the fuel tank chamber when the fuel tank is being filled past the capacity of the fuel tank chamber. As embodied herein and shown in FIGS. 2–4 for example, the overflow fuel housing means preferably includes a top wall 30, a bottom wall 32, and a side wall 34 connecting top wall 30 and bottom wall 32.

In further accordance with the present invention, the bottom wall preferably defines at least one fuel inlet opening therethrough. As embodied herein and shown in FIGS. 3 and 4 for example, bottom wall 32 defines a fuel inlet opening 36 therethrough.

In further accordance with the pollution control device of the present invention, means are provided for conveying to the overflow fuel housing means, fuel overflowing from the fuel tank chamber when the fuel tank is being filled past capacity. The conveying means communicates with the fuel tank chamber and with the overflow fuel housing means. As embodied herein and shown in FIG. 3 for example, the means for conveying fuel overflowing from the fuel tank chamber when the fuel tank is being filled past capacity to the overflow fuel housing means preferably includes a conduit 38 (shown in phantom) and a fuel inlet tube 40. Conduit 38 communicates with fuel tank chamber 18 via vent opening 28 and fuel tank chamber vent line 24, which is shown in phantom in FIG. 1 for example. As sown in FIG. 3 for example, conduit 38 preferably defines a right angle elbow fitted at one end to one end of fuel inlet tube 40 and configured at the opposite end to be detachably coupled to vent opening 28 in hull 14.

Figure 3:
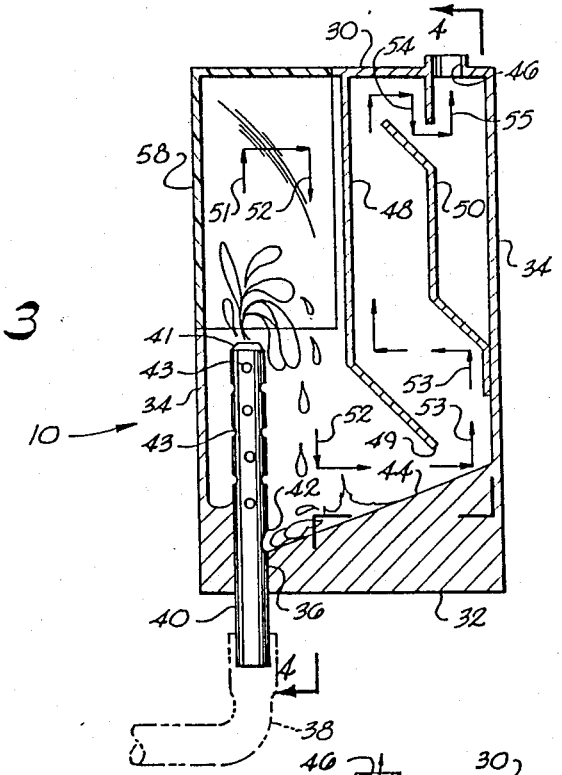
FIG. 3 illustrates a cross-sectional view taken along the lines 3—3 of FIG. 2.
Figure 4:
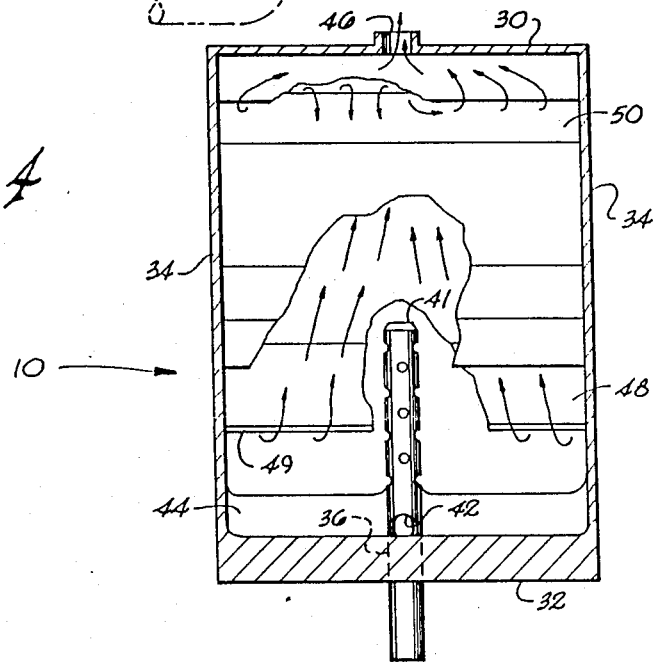
FIG. 4 illustrates a cross-sectional view taken along the lines 4—4 of FIG. 3.

As shown in FIGS. 3 and 4 for example, fuel inlet tube 40 communicates with conduit 38 and is disposed inside the overflow fuel housing means. Fuel inlet tube 40 preferably is connected to fuel inlet opening 36 or extends therethrough and upwardly therefrom to a predetermined height within the overflow fuel housing means. Thus, fuel inlet tube 40 has a free end 41 which terminates inside the overflow fuel housing means at a predetermined height. Fuel inlet tube 40 also has a plurality of ejection holes 43 defined therethrough and along the length thereof. Fuel may enter the overflow fuel housing means through one or more ejections holes 43 or may be ejected from free end 41, if the slug of fuel has sufficient impetus.

In further accordance with the pollution control device of the present invention, means are provided for returning to the fuel tank chamber liquid fuel overflowing from the fuel tank chamber when the fuel tank is being filled past capacity. The liquid fuel return means preferably communicates with the overflow fuel housing means and with the fuel tank chamber. As embodied herein and shown in FIGS. 3 and 4 for example, the liquid fuel return means preferably includes at least one fuel outlet opening 42 defined in fuel inlet tube 40. The liquid fuel return means further includes a sloped floor 44 disposed above bottom wall 32 of the overflow fuel housing means. Sloped floor 44 is configured to slope toward fuel outlet opening 42. Liquid fuel outlet opening 42 preferably is disposed in fuel inlet tube 40 so as to be at the same level as sloped floor 44 in the vicinity of fuel inlet tube 40.

In still further accordance with the pollution control device of the present invention, means are provided for venting to atmosphere the volatile vapors emanating from the fuel being stored in the fuel tank. The fuel vapor venting means preferably communicates with the interior of the overflow fuel housing means. As embodied herein and shown in FIGS. 2–4 for example, the fuel vapor venting means includes at least one vapor opening 46 defined in top wall 30 of the overflow fuel housing means. Vapor opening 46 connects the interior of the overflow fuel housing means with the atmosphere outside of the overflow fuel housing means. Thus, vapors contained within the overflow fuel housing means can escape the interior of the overflow fuel housing means by passing through vapor opening 46 and entering the surrounding atmosphere.

In still further accordance with the fuel pollution control device of the present invention, means are provided for baffling the path of fluid within the overflow fuel housing means to prevent escape of liquid fuel from the overflow fuel housing means. The liquid fuel escape prevention means preferably is defined within the overflow fuel housing means. As embodied herein and shown in FIGS. 3 and 4 for example, the liquid fuel escape prevention means preferably includes at least two baffles 48, 50. At least one of the baffles is a separation battle 48 which is disposed inside the overflow fuel housing means and extends downwardly from top wall 30 of the overflow fuel housing means to a predetermined height. Separation baffle 48 functions to physically separate from each vapor opening 46, the liquid fuel entering the overflow fuel housing means via fuel inlet tube 40. Separation baffle 48 has a free end 49 which points toward bottom wall 32 and away from fuel outlet opening 42.

At least another of the baffles defines a flow turning baffle 50 which is also disposed within the overflow fuel housing means. Flow turning baffle 50 is disposed on the same side of separation baffle 48 as vapor opening 46. Flow turning baffle 50 is configured to cause vapor to turn at least 180° before exiting through one of vapor openings 46.

As shown for example in FIG. 3, arrow 51 points in the direction that liquid fuel is moving as it enters the overflow fuel housing means through fuel inlet tube 40. By the time the liquid fuel is moving in the direction indicated by arrows 52, the liquid fuel has turned 180° from the direction indicated by arrow 51. By the time the liquid fuel is moving in the direction indicated by arrows 53, the liquid fuel has turned an additional 180°. When the vapor is moving in a direction indicated by arrow 54, the vapor has turned yet an additional 180°. Finally, when the vapor is moving in a direction indicated by arrow 55, the vapor has turned still another 180° prior to entering the ambient atmosphere.

The fuel escape prevention means further includes the extension of liquid fuel inlet tube 40 into the overflow fuel housing means upwardly from bottom wall 32 and having a free end 41 terminating at a height above the predetermined height where separation baffle 48 terminates at its free end 49.

In yet further accordance with the fuel pollution control device of the present invention, means are provided to permit visual observation of fuel overflowing from the fuel tank chamber and entering the overflow fuel housing means. As embodied herein and shown in FIGS. 1–3 for example, the means for permitting visual observation of overflowing fuel includes a window 58 defined in the overflow fuel housing means and disposed therein to permit visual observation of fuel entering the overflow fuel housing means through fuel inlet tube 40. Window 58 preferably defines a transparent section in an upper portion of side wall 34 and a portion of top wall 30 contiguous with the upper portion of side wall 34. As shown in FIG. 1 for example, window 58 is disposed so as to be visible to an operator who is filling fuel tank 16 via fuel tank chamber inlet nozzle 20. In alternative embodiments, window 58 can be defined only in side wall 34 or only in top wall 30.

To use the present invention, a person keeps an eye on window 58 of pollution control device 10 while filling of fuel tank 16. As soon as the operator observes fuel entering the overflow fuel housing means by observing same through window 58, the operator stops pouring fuel into fuel tank 16. The fuel spurting through free end 41 or ejection openings 43 of inlet tube 40 reaches there via fuel tank chamber vent line 24, vent opening 28, conduit 38, fuel inlet opening 36, and fuel inlet tube 40. The fuel entering the overflow fuel housing means includes both liquid and vapor. The liquid fuel falls to sloped floor 44 and eventually travels under the influence of gravity to exit the overflow fuel housing means via fuel outlet opening 42 provided at the place where sloped floor 44 meets fuel inlet tube 40. When fuel no longer is overflowing from fuel tank 16, the liquid fuel can escape back down into fuel tank 16 via fuel inlet opening 36, conduit 38, vent opening 28, and fuel tank chamber vent line 24. The fuel vapor residing inside the overflow fuel housing means must make a plurality of turns, including at least one 180° turn, in order to follow the path indicated by arrows 51–55 to exit the overflow fuel housing means via vapor opening 46 and pass into the atmosphere. As the vapor makes each turn in this path, any entrained liquid fuel is spun out of the vapor path under the influence of centrifugal force as the vapor makes these turns. Baffles 48, 50 serve to prevent liquid fuel from exiting vapor opening 46. Accordingly, liquid fuel does not escape into the environment to pollute same.

The improved marine fuel tank vent assembly of this invention can be constructed using any suitable material or combination of materials such as brass, glass, stainless steel, etc. Further, inlet and outlet connections to the marine fuel tank should be properly sealed to prevent fuel leaks.

The sizing of the overflow fuel housing means must be large enough so that the level of stored liquid fuel is away from the top where the vapor openings are located. Thus, in sizing the overflow fuel housing, due regard must be given to the amount of fuel that might be pumped into it during the time it takes the person who is filling the tank to react to the visual observation of the fuel entering the overflow fuel housing means.

Having described the present invention in detail, it is apparent that those skilled in the art will be able to make variations and modifications thereto without departing from the scope or spirit of the invention. Thus, it is intended that the present invention cover the variations and modifications of this invention, provided they come within the scope of the appended claims and their equivalents.

What is claimed is:

1. A watercraft powered by an internal combustion engine consuming volatile liquid fuel, the craft comprising:

(a) a hull floatable in water;

(b) an internal combustion engine supported by said hull for propelling same through the water;

(c) at least one fuel tank for storing the liquid fuel to be consumed by said engine, said tank being supported by said hall and defining a fuel tank chamber where the fuel is to be stored;

(d) a fuel pollution control device communicating with the interior of said fuel tank chamber, said fuel pollution control device comprising;

(i) means for housing fuel overflowing from said fuel tank chamber when said fuel tank is being filled past the capacity of said chamber;

(ii) means for conveying to said overflow fuel housing means fuel overflowing from said fuel tank chamber when said fuel tank is being filled past capacity, said conveying means communicating with said fuel tank chamber and with said overflow fuel housing means;

(iii) means for returning to said fuel tank chamber liquid fuel overflowing from said fuel tank chamber when said fuel tank is being filled past capacity, said liquid fuel return means communicating with said overflow fuel housing means and with said fuel tank chamber;

(iv) means for venting to atmosphere volatile vapors from fuel being stored in said fuel tank, said fuel vapor venting means being connected to said overflow fuel housing means;

(v) means for baffling the path of fluid within said overflow fuel housing means to prevent escape of liquid fuel from said overflow fuel housing means, said liquid fuel escape prevention means being defined within said overflow fuel housing means; and (vi) means for permitting visual observation of fuel overflowing from said fuel tank chamber and entering said overflow fuel housing means.

2. An apparatus as in claim 1, wherein said overflow fuel housing means includes:

(i') a top wall, a bottom wall and a side wall connecting said top and bottom walls; and (ii') said bottom wall defining at least one fuel inlet opening therethrough.

3. An apparatus as in claim 1, wherein said conveying means includes:

(i) a conduit connecting said fuel tank chamber to said overflow fuel housing means, one end of said conduit communicating with an uppermost portion of said fuel tank chamber and the opposite end of said conduit communicating with a bottom portion of said overflow fuel housing; and (ii) a fuel inlet tube communicating with said conduit and disposed inside said overflow fuel housing means and connected to said fuel inlet opening in said bottom portion of said overflow fuel housing means and extending upwardly therefrom to a predetermined height within said overflow fuel housing means.

4. An apparatus as in claim 3, wherein said liquid fuel return means includes:

(i') at least one liquid fuel outlet opening defined in said fuel inlet tube;

(ii') a sloped floor disposed above the bottom of said overflow fuel housing means, said floor being configured to slope toward said fuel outlet opening; and (iii') said liquid fuel outlet opening being disposed in said fuel inlet tube so as to be at the same level as said sloped floor in the vicinity nearest said fuel inlet tube.

5. An apparatus as in claim 1, wherein said fuel vapor venting means includes at least one vapor opening defined in the top of said overflow fuel housing means, said vapor opening communicating with the atmosphere.

6. An apparatus as in claim 5, wherein:

said liquid fuel escape prevention means includes at least two baffles:

(i') at least one of said baffles being a separation baffle, said separation baffle being disposed inside said overflow fuel housing means and extending downwardly from the top of said overflow fuel housing means to a predetermined height so as to physically separate the liquid fuel entering said overflow fuel housing means from each said vapor opening;

(ii') at least another of said baffles defining a flow turning baffle, said flow turning baffle being disposed within said overflow fuel housing means and on the same side as each said vapor opening, said flow turning baffle being configured to cause vapor to turn at least 180° before existing through one of each said vapor openings; and (iii') a liquid fuel inlet tube extending into said overflow fuel housing means upwardly from the bottom of said overflow fuel housing means and having a free end terminating at a height above said predetermined height where said separation baffle terminates.

7. An apparatus as in claim 1, wherein said mans for permitting visual observation of overflowing fuel includes a window defined in said overflow fuel housing means and disposed therein to permit visual observation of fuel entering said overflow fuel housing means.

8. A watercraft powered by an internal combustion engine consuming volatile liquid fuel, the craft comprising:

(a) a hull floatable in water;

(b) an internal combustion engine supported by said hull for propelling same through the water;

(c) at least one fuel tank for storing the liquid fuel to be consumed by said engine, said tank being supported by said hall and defining a chamber where the fuel is to be stored;

(d) means for housing fuel overflowing from said fuel tank chamber when said fuel tank is being filled past the capacity of said chamber, said overflow fuel housing means including:

(i) a top wall, a bottom wall and a side wall connecting said top and bottom walls;

(ii) said bottom wall defining at least one fuel inlet opening therethrough;

(e) means for conveying to said overflow fuel housing means fuel overflowing from said fuel tank chamber when said fuel tank is being filled past capacity, said conveying means including:

(i) a conduit having one end communicating with each said fuel inlet opening and having an opposite end communicating with an uppermost portion of said fuel tank chamber, and (ii) a fuel inlet tube having one end connected to said fuel inlet opening and an opposite end being a free end disposed within said overflow fuel housing means at a predetermined height above said bottom wall of said overflow fuel housing means;

(f) means for returning to said fuel tank chamber liquid fuel overflowing from said fuel tank chamber when said fuel tank is being filled past capacity, said liquid fuel return means including:

(i) at least one liquid fuel outlet opening defined in said fuel inlet tube, (ii) a sloped floor disposed above said bottom wall of said overflow fuel housing means, said floor being configured to slope toward each said liquid fuel outlet opening, and (iii) said liquid fuel outlet opening being disposed so as to be at the same level as said sloped floor in the vicinity nearest said fuel inlet tube;

(g) means for venting to atmosphere vapors from fuel being stored in said fuel tank, said fuel vapor venting means including at least one vapor opening defined in said top wall of said overflow fuel housing means, said vapor opening communicating with the atmosphere;

(h) means for preventing escape of liquid fuel from said overflow fuel housing means, said liquid fuel escape prevention means including:

(i') at least one separation baffle being disposed inside said overflow fuel housing means so as to physically separate the liquid fuel entering said overflow fuel housing means from each said vapor opening, said separation baffle having one end attached to said top wall of said overflow fuel housing means and extending downwardly towards said bottom wall until reaching approximately the height of the free end of said fuel inlet tube and extending downwardly towards said bottom wall and away from said liquid fuel outlet opening, and (ii') a flow turning baffle being disposed within said overflow fuel housing means on the same side of said separation baffle as each said vapor opening, said flow turning baffle being configured to cause vapor to turn at least 180° before exiting through one of each said vapor openings; and (i) means for permitting visual observation of fuel overflowing from said fuel tank chamber and entering said overflow fuel housing means, said visual observation permitting means including a window defined in said overflow fuel housing means and disposed therein to permit visual observation of fuel entering said overflow fuel housing means.

9. A fuel pollution control apparatus to be connected in fluid communication with the interior of a fuel tank chamber of a marine craft powered by an internal combustion engine, the apparatus comprising:

(a) means for housing fuel overflowing from said fuel tank chamber when said fuel tank is being filled past the capacity of the fuel tank chamber;

(b) means for conveying to said overflow fuel housing means fuel overflowing from said fuel tank chamber when said fuel tank is being filled past capacity, said conveying means communicating with said fuel tank chamber and with said overflow fuel housing means;

(c) means for returning to said fuel tank chamber liquid fuel overflowing from said fuel tank chamber when said fuel tank is being filled past capacity, said liquid fuel return means communicating with said fuel tank chamber and with said overflow fuel housing means;

(d) means for venting to atmosphere volatile vapors from fuel being stored in said fuel tank, said fuel vapor venting means being connected to said overflow fuel housing means and being in communication with said fuel tank chamber and the atmosphere;

(e) means for baffling the path of fluid within said overflow fuel housing means to prevent escape of liquid fuel from said overflow fuel housing means, said liquid fuel escape prevention means being defined within said overflow fuel housing means; and (f) means for permitting visual observation of fuel overflowing from said fuel tank chamber and entering said overflow fuel housing means.

10. An apparatus as in claim 9, wherein said overflow fuel housing means includes:

(i) a top wall, a bottom wall and a side wall connecting said top and bottom walls; and (ii) said bottom wall defining at least one fuel inlet opening therethrough.

11. An apparatus as in claim 9, wherein said conveying means includes:

(i) a conduit connecting said fuel tank chamber to said overflow fuel housing means, one end of said conduit communicating with an uppermost portion of said fuel tank chamber and the opposite end of said conduit communicating with a bottom portion of said overflow fuel housing; and (ii) a fuel inlet tube communicating with said conduit and disposed inside said overflow fuel housing means and connected to said fuel inlet opening in said bottom portion of said overflow fuel housing means and extending upwardly therefrom to a predetermined height within said overflow fuel housing means.

12. An apparatus as in claim 11, wherein said liquid fuel return means includes:

(i) at least one liquid fuel outlet opening defined in said fuel inlet tube;

(ii) a sloped floor disposed above the bottom of said overflow fuel housing means, said floor being configured to slope toward said liquid fuel outlet opening; and (iii) said liquid fuel outlet opening being disposed in said inlet tube so as to be at the same level as said sloped floor in the vicinity nearest said inlet tube.

13. An apparatus as in claim 9, wherein said fuel vapor venting means includes at least one vapor opening defined in the top of said overflow fuel housing means, said vapor opening communicating with the atmosphere.

14. An apparatus as in claim 13, wherein said liquid fuel escape prevention means includes at least two baffles:

(i) at least one of said baffles being a separation baffle, said separation baffle being disposed inside said overflow fuel housing means and extending downwardly from the top of said overflow fuel housing means to a predetermined height so as to physically separate the liquid fuel entering said overflow fuel housing means from each said vapor opening;

(ii) at least another of said baffles defining a flow turning baffle, said flow turning baffle being disposed within said overflow fuel housing means and on the same side of said separation baffle as each said vapor opening, said flow turning baffle being configured to cause vapor to turn at least 180° before existing through one of each said vapor openings; and (iii) a liquid fuel inlet tube extending into said overflow fuel housing means upwardly from the bottom of said overflow fuel housing means and having a free end terminating at a height above said predetermined height where said separation baffle terminates.

15. An apparatus as in claim 9, wherein said means for permitting visual observation of overflowing fuel includes a transparent section defined in said overflow fuel housing means and disposed therein to permit visual observation of fuel entering said overflow fuel housing means.

16. A fuel pollution control apparatus to be connected in fluid communication with the interior of a fuel tank chamber of a marine craft powered by an internal combustion engine, the apparatus comprising:

(a) means for housing fuel overflowing from said fuel tank chamber when said fuel tank is being filled past its capacity, said overflow fuel housing means including:
  (i) a top wall, a bottom wall, and
  (ii) a side wall connecting said top and bottom walls;

(b) means for conveying to said overflow fuel housing means fuel overflowing from said fuel tank chamber when said fuel tank is being filled past capacity, said conveying means including:
  (i) at least one fuel inlet opening defined through said bottom wall,
  (ii) a conduit having one end communicating with each said fuel inlet opening and having an opposite end communicating with an uppermost portion of said fuel tank chamber, and
  (iii) a fuel inlet tube having one end connected to said fuel inlet opening and an opposite end being a free end disposed within said overflow fuel housing means at a predetermined height above said bottom wall of said overflow fuel housing means;

(c) means for returning to said fuel tank chamber liquid fuel overflowing from said fuel tank chamber when said fuel tank is being filled past capacity, said liquid fuel return means communicating with said overflow fuel housing means and with said fuel tank chamber, said liquid fuel return means including:
  (i) a sloped floor disposed above said bottom wall of said overflow fuel housing means,
  (ii) at least one liquid fuel outlet opening defined in said fuel inlet tube so as to be at the same level as said sloped floor in the vicinity nearest said fuel inlet tube, and
  (iii) said floor being configured to slope toward each said liquid fuel outlet opening;

(d) means for venting to atmosphere volatile vapors from fuel being stored in said fuel tank, said fuel vapor venting means being connected to said overflow fuel housing means and being in communication with said fuel tank chamber, said fuel vapor venting means including at least one vapor opening defined in said top wall of said overflow fuel housing means, said vapor opening communicating with the atmosphere;

(e) means for preventing escape of liquid fuel from said overflow fuel housing means, said liquid fuel escape prevention means including:
  (i) at least one separation baffle being disposed inside said overflow fuel housing means so as to physically separate the liquid fuel entering said overflow fuel housing means from each said vapor opening, said separation baffle having one end attached to said top wall of said overflow fuel housing means and extending downwardly towards said bottom wall until reaching approximately the height of the free end of said fuel inlet tube and extending downwardly towards said bottom wall and away from said liquid fuel outlet opening, and
  (ii) a flow turning baffle being disposed within said overflow fuel housing means on the same side of said separation baffle as each said vapor opening, said flow turning baffle being configured to cause vapor to turn at least 180° before exiting through one of said vapor openings; and (f) means for permitting visual observation of fuel overflowing from said fuel tank chamber and entering said overflow fuel housing means, said visual observation permitting means including a transparent section defined in said overflow fuel housing means and disposed therein to permit visual observation of fuel entering said overflow fuel housing means.

17. A fuel pollution control apparatus to be connected to a fuel tank chamber of a marine craft powered by an internal combustion engine, the apparatus comprising:

(a) means for housing fuel overflowing from said fuel tank chamber when said fuel tank is being filled past capacity, said housing means adapted for communication with a vent opening in a water craft for venting fumes from a marine fuel tank so that an interior of said housing communicates with said tank chamber for passage of fuel and fumes therebetween;

(b) said housing defining at least one section adapted to allow for viewing fuel flow into said housing;

(c) means for returning to said fuel tank chamber liquid fuel overflowing from said fuel tank when said fuel tank chamber is being filled past capacity, said liquid fuel return means being secured to said housing and adapted for fuel communication with said tank chamber for fuel return thereto;

(d) means for venting to atmosphere volatile vapors from fuel being stored in said fuel tank, said fuel vapor venting means being secured to said housing remote from said liquid fuel return means for return of fuel fumes to the atmosphere; and (e) means for preventing escape of liquid fuel from said housing means, said liquid fuel escape prevention means being received within said housing means and including a baffle configured and located to deflect liquid fuel within said housing means to said liquid fuel return means while permitting fuel fumes passage to said fuel vapor venting means so that when the apparatus is attached in communication with a marine fuel tank chamber, liquid fuel overflow will pass into said housing means and return to the fuel tank while fumes associated therewith will exit said housing means through said fuel vapor venting means.

18. An apparatus as in claim 17, wherein said liquid fuel escape prevention means further includes a flow turning baffle configured and disposed in said housing means to prevent flow of fuel to said fuel vapor venting means in a straight line flow of fuel.

* * * * *